US006764237B2

(12) United States Patent
Itou

(10) Patent No.: US 6,764,237 B2
(45) Date of Patent: Jul. 20, 2004

(54) PRINTER WITH CUTTER DEVICE

(75) Inventor: Sueo Itou, Saitama (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/670,475

(22) Filed: Sep. 26, 2003

(65) Prior Publication Data

US 2004/0076458 A1 Apr. 22, 2004

(30) Foreign Application Priority Data

Sep. 27, 2002 (JP) ..... 2002-282176

(51) Int. Cl.[7] ..... B41J 29/02
(52) U.S. Cl. ..... 400/693; 400/621; 400/663
(58) Field of Search ..... 400/621, 621.1, 400/663, 664, 693

(56) References Cited

U.S. PATENT DOCUMENTS 6,408,750 B1 6/2002 Goto et al.
2002/0051669 A1 * 5/2002 Otsuka et al. ..... 400/619

FOREIGN PATENT DOCUMENTS

JP 57197185 A * 12/1982
JP 2000335028 A * 12/2000
JP 2000-335029 A 12/2000

* cited by examiner

*Primary Examiner*—Daniel J. Colilla
*Assistant Examiner*—Jill E. Culler
(74) *Attorney, Agent, or Firm*—Sughrue Mion, PLLC

(57) ABSTRACT

A printer with a cutter device is provided with a lid which is open when a paper-feeding magazine is taken out. A receiver for receiving paper dust is disposed next to the lid. The lid and the receiver respectively have an engaging plate and an engaged plate for engaging with each other. If the lid is open when exchanging a recording paper, the engaging plate pushes the engaged plate in association with the operation to open of the lid. Thereby, the receiver is pulled out in a removing direction where the paper-feeding magazine is removed, and then a part of a containing chamber for accumulating the paper dust is exposed. If the containing chamber is full of the paper dust, the paper dust is discarded after the receiver has been completely removed.

9 Claims, 10 Drawing Sheets

PRINTER WITH CUTTER DEVICE

BACKGROUND OF THE INVENTION

1. Field of the Invention

The present invention relates to a printer with a cutter device, and more specifically, to a printer having a receiver for receiving paper dust generated by cutting a recording paper.

2. Description of the Prior Arts

A color thermal printer is provided with a thermal head for recording an image on a color thermal recording paper. While the thermal head records three-color images according to the three-color frame-sequential recording, the color thermal recording paper is fed in forward and backward directions in a state of being nipped by a feeding roller pair. Although the thermal head is disposed near the feeding roller pair, the image cannot be recorded on front and rear ends of the color thermal recording paper corresponding to a distance between the feeding roller pair and the thermal head. The color thermal recording paper is nipped between the thermal head and a platen roller; however, if the platen roller is heated by both end parts of the thermal head which are not in contact with the color thermal recording paper, the platen roller may be deformed by the heat, or the life thereof may deteriorate. Therefore, margins are left at the lateral ends of the color thermal recording paper, and the image is recorded on an image recording region surrounded by the margins. After the recording, the margins are formed at a front end, a rear end, and side ends of the image recording region along a feeding direction of the color thermal recording paper.

Recently, since marginless prints are widely used, there has been known a printer provided with a cutter for cutting away all the margins from the recording region. To cut the margins, it is preferable to use a front and rear margin cutter and a slitter for cutting away lateral margins. In U.S. Pat. No. 6,408,750, a receiver for receiving paper dust generated by cutting the recording paper is provided below the cutter device. Thereby, it is possible to prevent the paper dust from being scattered in the printer. The receiver is attached to the printer in a removable manner. When the paper dust is filled to the capacity of the receiver, the paper dust is discarded after the receiver has been removed from the printer.

In addition, there has been known the printer in which the rolled recording paper is used and in which the image is recorded thereon. In Japanese Patent Laid-Open Publication No. 2000-335029, the printer is provided with the cutter device for cutting the recording paper into a sheet after recording the image thereon. In addition to cutting the recording paper into a sheet, since the cutter device cuts away the margin between the rear end of the recording sheet, which was previously cut, and the front end of the image recording region, which is presently recorded, it is necessary to provide a receiver for receiving the paper dust including the front margin.

In the printer with the cutter device described in the above-mentioned publications, however, since it is necessary to confirm whether the receiver is full of the paper dust or not after removing the receiver, such operation is troublesome. If the operation is omitted, the paper dust may be scattered in the printer after the paper dust amount has exceeded the capacity of the receiver, and it is likely to affect various mechanisms in the printer. A sensor for detecting the paper dust amount in the receiver or the printer may increase the manufacture cost.

SUMMARY OF THE INVENTION

An object of the present invention is to provide a printer with a cutter device at low cost, capable of easily confirming whether a receiver is full of paper dust or not.

Another object of the present invention is to provide a printer with a cutter device capable of preventing paper dust from scattering in the printer not to interfere with the operation of the printer.

The above objects are achieved by providing a printer with a cutter device in which a receiver is provided in a removable manner, and which includes interlocking means for moving the receiver to an exposed position where a part of containing chamber is exposed in association with the movement of a lid to an open position. The lid is open when recording paper or a magazine for containing the recording paper is mounted.

In the printer, the receiver is provided with the containing chamber for receiving paper dust generated by cutting a recording paper. The lid is rotatable between a closed position to cover a loading chamber and an open position to expose the loading chamber. The interlocking mechanism is operated for connecting the lid with the receiver, and moves the receiver from a contained position where the containing chamber is completely contained in the printer to the exposed position. In addition, the interlocking mechanism includes an engaging member fixed to the lid and an engaged member fixed to the receiver. The engaging member pushes the engaged member, so that the receiver is moved to the exposed position in association with the movement of the lid to the open position.

According to the present invention, when the recording paper or the magazine for containing the recording paper is mounted, the interlocking means moves the receiver to the exposed position. Therefore, the amount of paper dust accumulated in the containing chamber can be confirmed when exchanging the recording paper. Thereby, it is possible to prevent the inconvenience of paper dust scattered in the printer for causing trouble with the operation of the printer.

BRIEF DESCRIPTION OF THE DRAWINGS

The above and other objects and advantages of the present invention will become apparent from the following detailed description of the preferred embodiments when read in association with the accompanying drawings, which are given by way of illustration only and thus are not limiting the present invention. In the drawings, like reference numerals designate like or corresponding parts throughout the several views, and wherein.

DETAILED DESCRIPTION OF THE PREFERRED EMBODIMENTS

Figure 1:
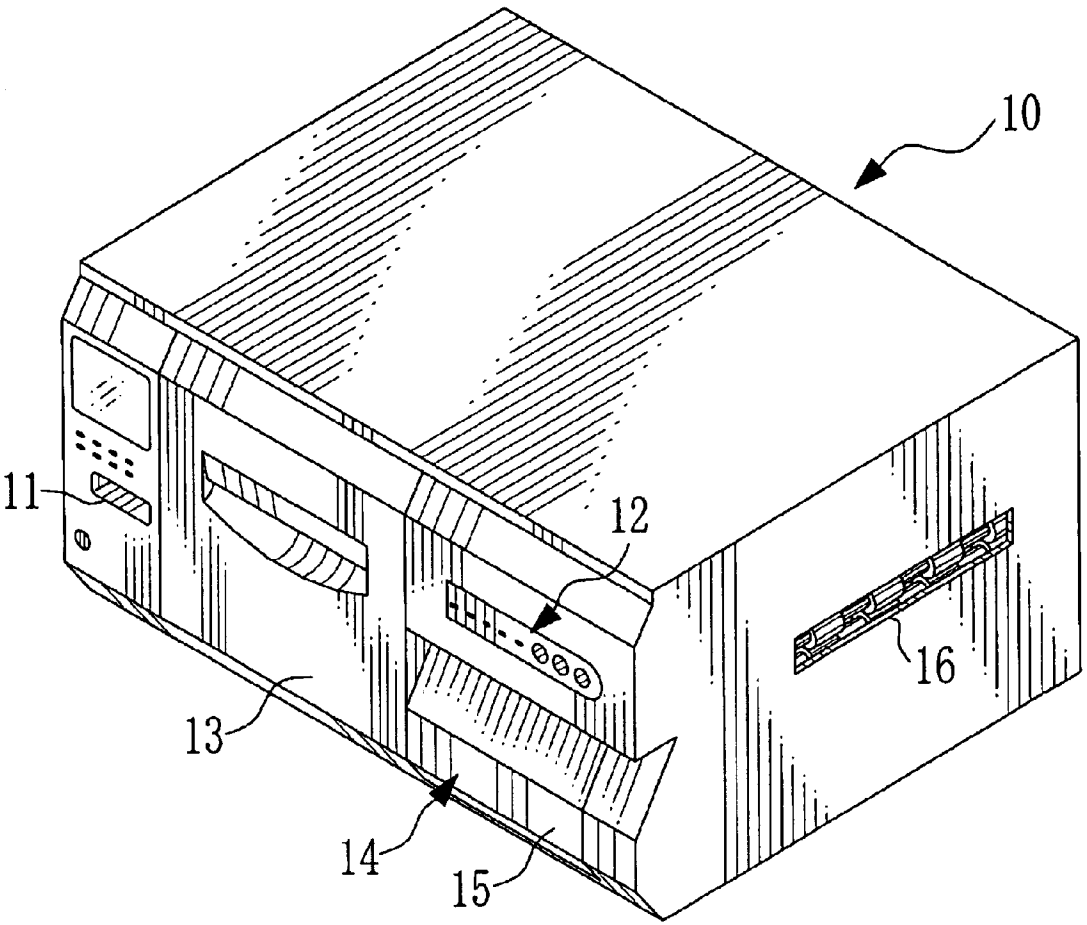
FIG. 1 is an external perspective view of a printer to which the present invention is applied.

As shown in FIG. 1, there are a slot 11, an operating section 12, a lid 13, and the like in a front surface of a printer 10. An ejection slot 16 is provided in a side surface of the printer 10. A handgrip portion 15 formed in a paper dust receiver 14 is disposed next to the lid 13, and operated for being gripped by a hand to remove the paper dust receiver 14. A magnetic storage media is set in the slot 11. The operating section 12 is constituted of a printing button, a selection button for selecting marginless print, and so forth. When an image data written in the magnetic storage media has been read out, the image data is recorded on a recording paper by recording means, and thereafter the recording paper on which the image has been recorded is ejected from the ejection slot 16 in the form of sheet.

Figure 2:
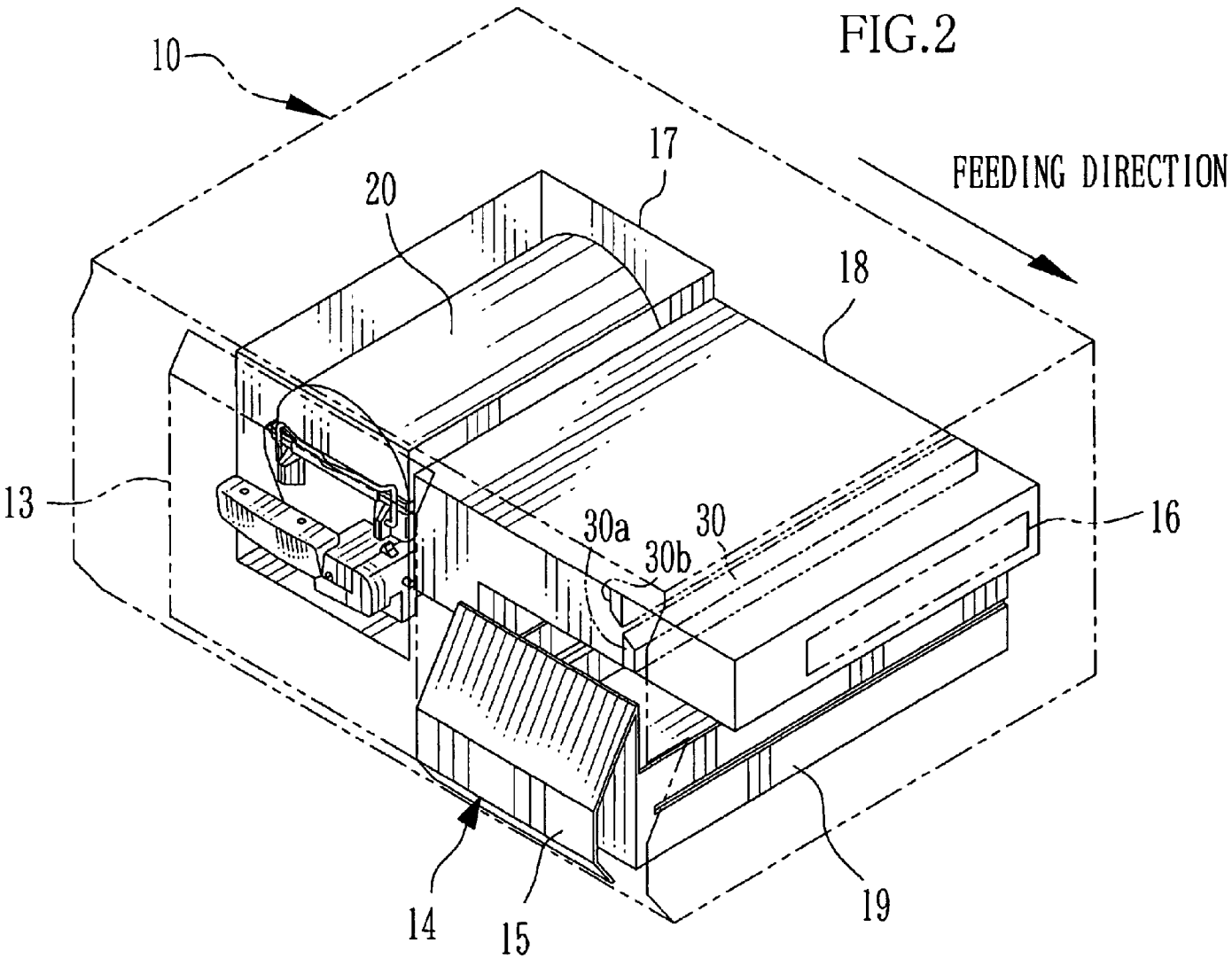
FIG. 2 is an outline explanatory view of the printer shown in FIG. 1.

As shown in FIG. 2, a loading chamber 17, a printing section 18, and the paper dust tray 14 are provided in the printer 10. A paper-feeding magazine 20 is loaded in the loading chamber 17. A recording paper wound into a roll shape is contained in the paper-feeding magazine 20, and a feeding mechanism is also contained therein. The feeding mechanism rotates the rolled recording paper by use of the driving force transmitted from the inside of the printer 10. Thereby, the front end of the recording paper is advanced along the feeding direction in the printing section 18.

The printing section 18 includes a feeding device, a thermal head, a cutter device 30, and so forth. The recording paper fed from the paper-feeding magazine 20 is advanced along the feeding direction by the feeding device. The thermal head records the image on an image recording area of the recording paper. The cutter device 30 is constituted of a stationary blade 30*a* and a movable blade 30*b*. After the image has been recorded by the thermal head, the movable blade 30*b* is moved vertically toward the stationary blade 30*a*, and then the front and rear end margins except for the image recording area are cut away. Note that any well-known cutter device can be used as the cutter device of the present invention.

After the margins have been cut away, the recording paper is fed in the feeding direction by the feeding device, and then ejected from the ejection slot 16. The paper dust receiver 14 is disposed under the cutter device 30, and has a containing chamber 19 for receiving the dropped paper dust and margin dust. The hand grip portion 15 is integrally provided in front of the containing chamber 19, and the front surface thereof forms a part of an outer cover of the printer 10.

Figure 3:
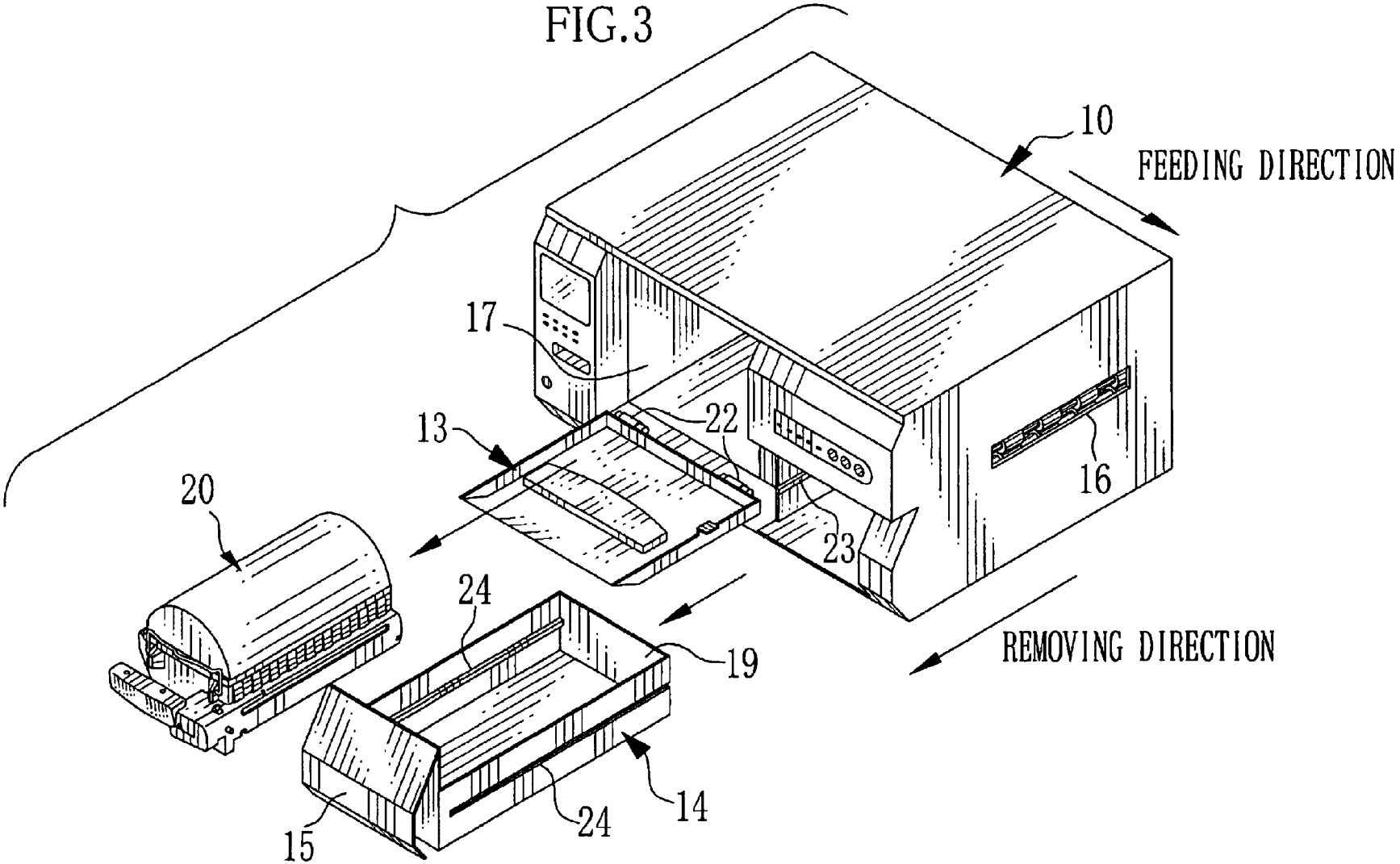
FIG. 3 is a perspective view of the printer, wherein a paper-feeding magazine and a paper dust receiver are removed.

As shown in FIG. 3, the lid 13 is attached to the front surface of the printer 10 by a hinge 22. The hinge 22 holds lid 13 so as to open the lid 13 freely between an open position and a closed position around a pair of shafts arranged parallel to the feeding direction. When the lid 13 is in the open position, the loading chamber 17 in the printer 10 is exposed, and the paper-feeding magazine 20 is removed from the loading chamber 17 in the direction perpendicularly to the feeding direction (removing direction). A rail receiving portion 24 engaged with a rail 23 is formed in the paper dust receiver 14. The rail 23 is provided in the printer 10 along the removing direction, and guides movement of the paper dust receiver 14 from a contained position where the containing chamber 19 is contained in the printer 10 to an exposed position where a part of the containing chamber 19 is exposed. Thereby, the paper dust receiver 14 can be removed in the same direction (removing direction) as the paper-feeding magazine.

Figure 4:
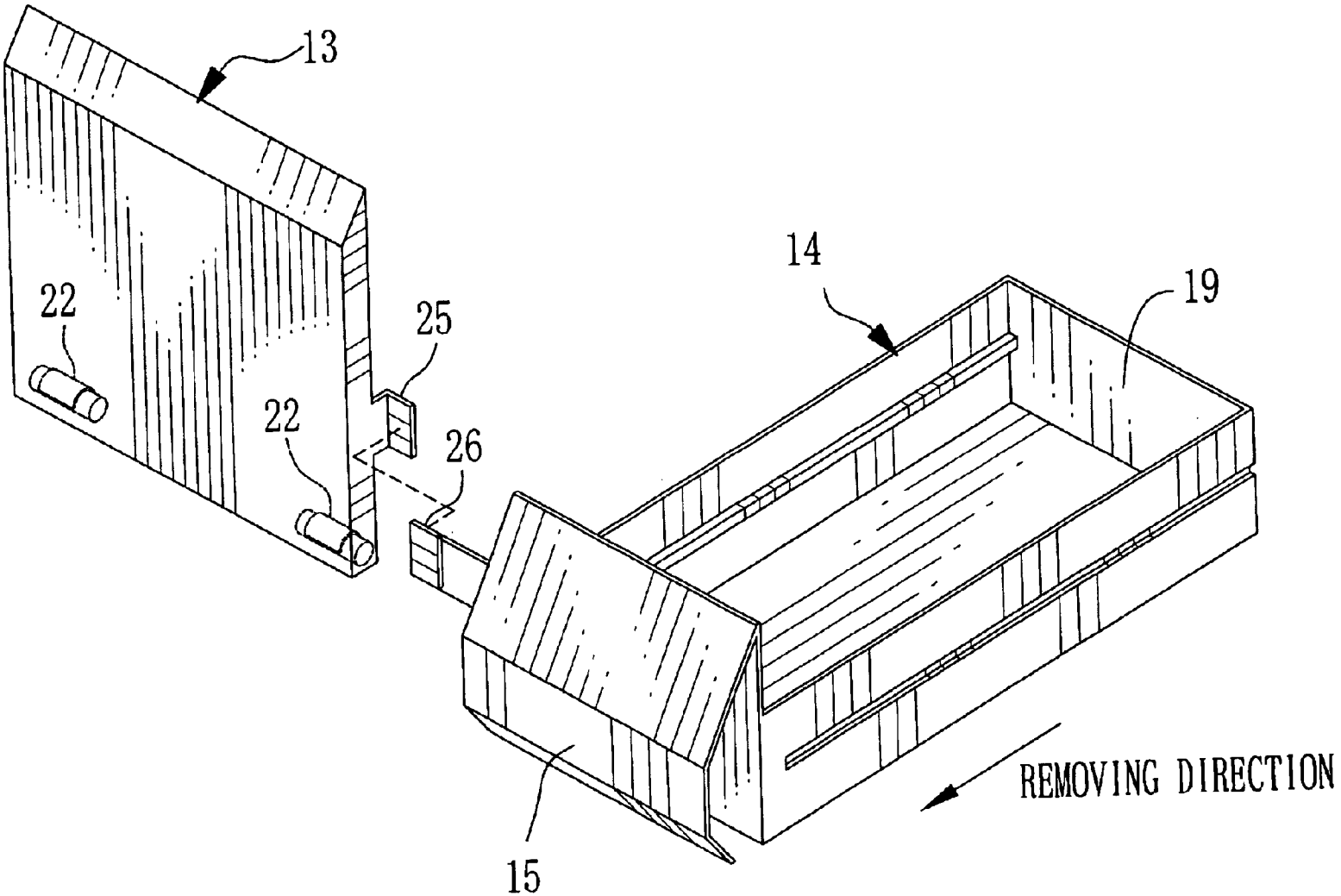
FIG. 4 is a perspective view showing a lid and the paper dust receiver interlocking with each other.

As shown in FIG. 4, an engaging plate 25 protruding toward the paper dust receiver 14 is integrally provided in the lid 13. Meanwhile, an engaged plate 26 protruding toward the lid 13 is integrally provided in the paper dust receiver 14. A rear surface of the engaged plate 26 is contacted with a front surface of the engaging plate 25 when the paper dust receiver 14 is in the contained position. The engaging plate 25 moves the paper dust receiver 14 to the removing direction by pushing the engaged plate 26 when the lid 13 rotates from the closed position to the open position.

The printer 10 is explained as a color thermal printer using the color thermal recording paper for example. The color thermal recording paper includes a cyan, a magenta, and a yellow thermosensitive coloring layers, and a transparent protective layer which are overlaid on a transparent or white support medium in sequence. If printing operation is started, the feeder roller in the paper-feeding magazine 20 is rotated by a feeder motor in the printer 10 so as to rotate the rolled recording paper. Thereafter, the front end of the recording paper is fed to the printing section 18 through a delivery opening of the paper-feeding magazine 20.

The recording paper fed to the printing section 18 is advanced to the thermal head by the feeding device. After that, the recording paper is reciprocally fed between the feeding direction and the backward direction thereof by the feeding device. The images of yellow, magenta, and cyan are printed successively while the recording paper is fed in the feeding direction. After the magenta and cyan images have been printed and fixed, coloring component remaining in each thermal coloring layer is decomposed. Note that the feeder roller is rotated in forward and backward direction while the recording paper is fed reciprocally.

After the printing, the recording paper is fed toward the cutter device 30 by the feeding device, and stopped at a position where the front end margin thereof is cut off by the movable blade 30*b*. Thereafter, the recording paper is fed at a position in which the cutter device 30 is operated for cutting the rear end margin. Thereby, the recording paper with the image recorded is cut off, to form a cut sheet from the continuous recording paper. The cut sheet is ejected from the ejection slot 16 by the feeding device. The paper dust and the margin dust generated by the cutter device 30 are dropped in the containing chamber 19.

If the printing is continuously carried out, after returning the front end of the recording paper to the thermal head, the next image is recorded on the recording paper similarly to the aforementioned. When the printing operation is completed, the front end of the continuous recording paper is rewound into the paper-feeding magazine 20 by the feeding device, and the delivery opening of the paper-feeding magazine 20 is blocked. Accordingly, the recording paper is protected from humidity.

Figure 5A:
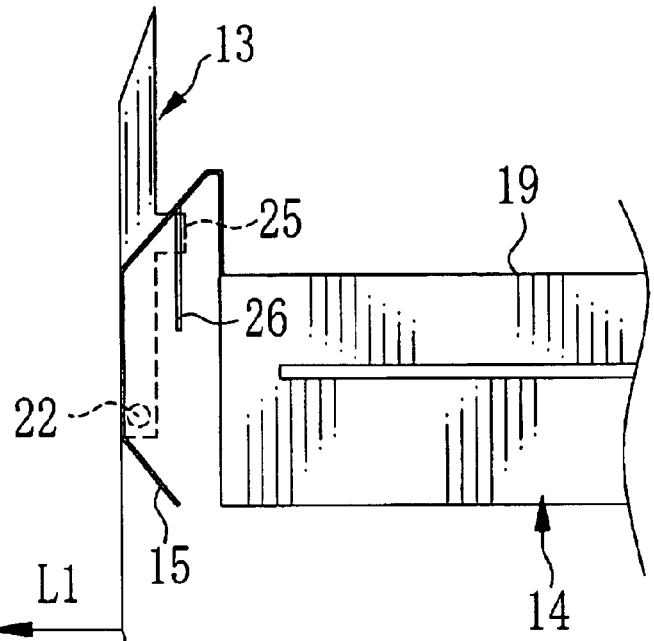
FIGS. 5A, 5B and 5C are explanatory views for explaining a process that the paper dust receiver is pushed out in association with the operation to open of the lid.
Figure 5B:
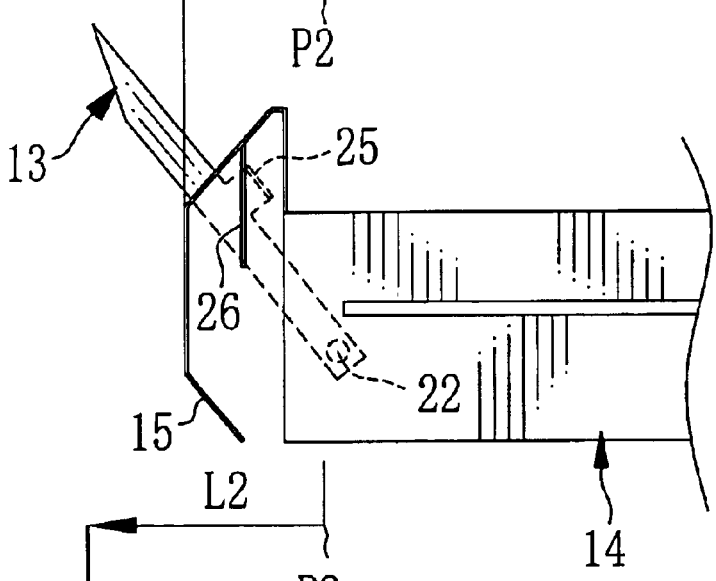
Figure 5C:
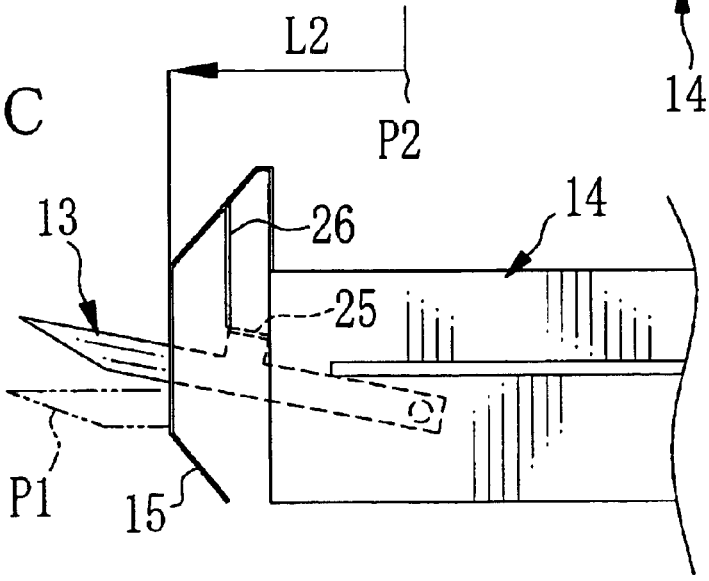

If the printer 10 detects, based on the signal from a sensor to detect the outer diameter of the rolled recording paper, that the remaining amount of the rolled recording paper becomes small, such information is displayed. After the display has been visually recognized, a user rotates the lid 13 to exchange the recording paper. At that time, the lid 13, which is in the closed position shown in FIG. 5A, is rotated around the hinge 22, so as to move to the open position. As shown in FIG. 5B, while the lid 13 is rotated, a top end of the front surface of the engaging plate 25 pushes the rear surface of the engaged plate 26 so that the paper dust receiver 14 is drawn out in the removing direction by the length L1. As shown in FIG. 5C, if the top end of the front surface of the engaging plate 25 is separated from the rear surface of the engaged plate 26, the lid 13 has reached the open position P1. Thereby, the paper dust receiver 14 is moved from the contained position P2 in the removing direction by the length L2, so that a part of the containing chamber 19 is exposed. Accordingly, the amount of the paper dust accumulated in the containing chamber 19 can be visually confirmed, so that it can prevent the scattered paper dust from having an adverse effect on cutting and feeding of the recording paper. If the containing chamber 19 is not filled with the paper dust, the paper dust receiver 14 is pushed back to the contained position P2. Meanwhile, if the capacity is fully occupied with the paper dust, the paper dust receiver 14 is completely removed to throw away the paper dust. After the paper dust has been removed, the paper dust receiver 14 is returned to the contained position P2.

When the rolled recording paper is exchanged, the lid 13 is open to remove the paper-feeding magazine 20. After the new rolled recording paper has been loaded, the paper-feeding magazine 20 is pushed back into the printer 10 in the direction opposite to the removing direction. In order to prevent the user from forgetting about removing the paper dust in exchanging the recording paper, it is preferable to attach a label to the outer surface of the printer 10, to show that the paper dust accumulated in the containing chamber 19 should be discarded. Furthermore, it is preferable to determine the capacity of the containing chamber 19 so that the amount of the paper dust in the containing chamber 19 may be almost full at the same time as the recording paper is exchanged.

In the above embodiment, the engagement of the engaging plate 25 and the engaged plate 26 is released when the lid 13 has reached the open position. However, if the paper dust receiver 14 is set in the printer 10 before the lid 13 is closed, the engaging plate 25 has become located in front of the engaged plate 26. Thereby, the lid 13 cannot be closed correctly, and to make matters worse, the lid 13 and the paper dust receiver 14 are not interlocked with each other. In order to prevent these problems, it is preferable that the lid 13 has reached the open position in a state that the engaging plate 25 is in contact with the engaged plate 26. In this case, when the user is reloading the paper dust receiver 14 in the printer 10 after removing the paper dust, since the engaging plate 25 is in the moving range of the engaged plate 26, the movement of the paper dust receiver 14 is prevented by engaging the engaging plate 25 and the engaged plate 26 with each other. Accordingly, it is possible to prevent the paper dust receiver 14 from being loaded in the printer before the lid 13 is closed.

In the above embodiment, the engaging plate 25 pushes the engaged plate 26 in association with the operation to open the lid 13, so that the paper dust receiver 14 is moved in the removing direction. However, the paper dust receiver 14 may be moved to the removing direction by releasing the engagement of the engaging plate 25 and the engaged plate 26.

Figure 6:
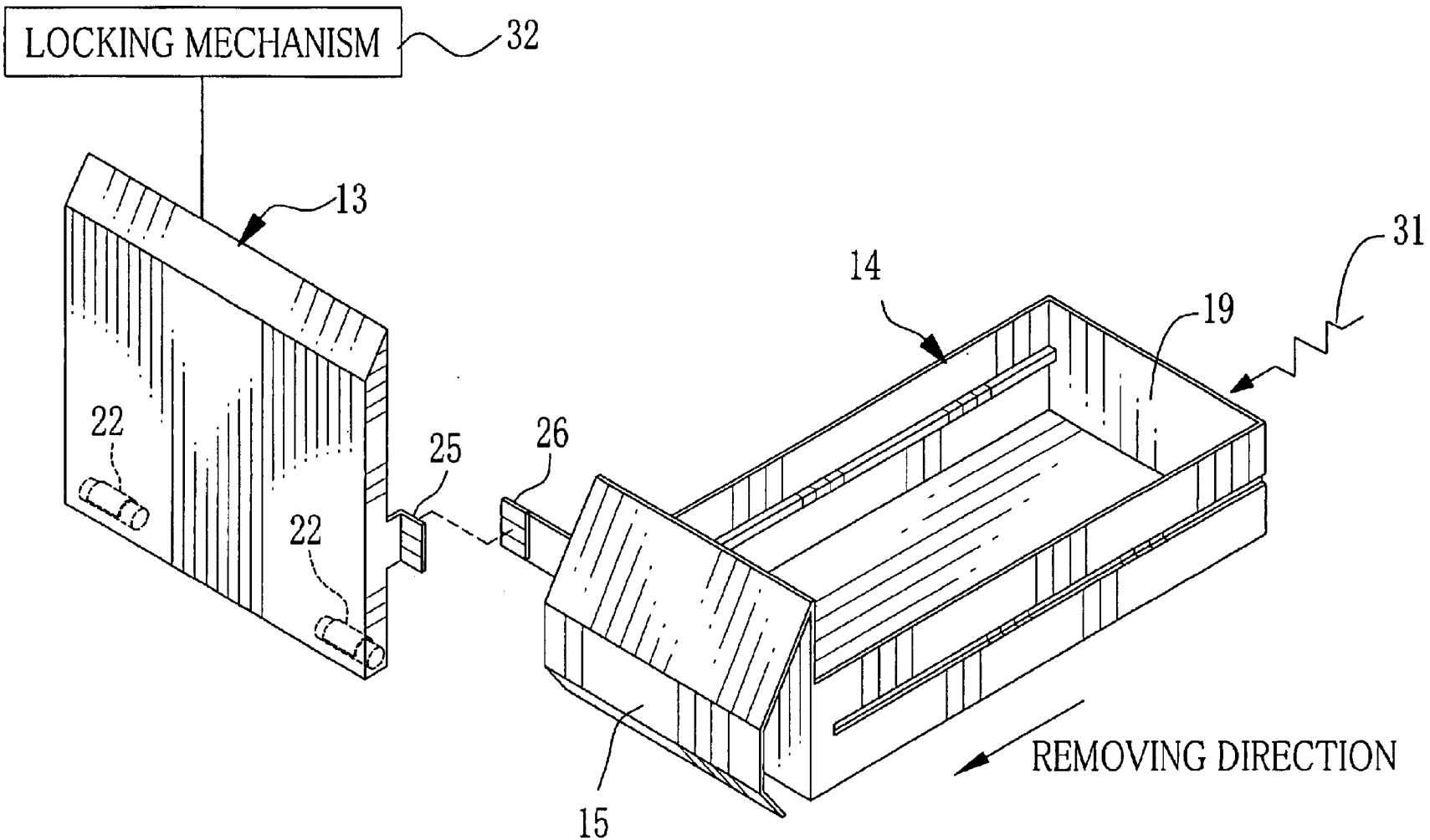
FIG. 6 is a perspective view showing another preferred lid and paper dust receiver.

In the example shown in FIG. 6, the paper dust receiver 14 is biased in the removing direction by a biasing member 31. The lid 13 is locked at the closed position by the locking mechanism 32. Any well-known mechanism is applicable to the locking mechanism of the present invention, for example the locking mechanism utilizing electrical/magnetic suction, the locking mechanism using the engagement with a claw, and so forth. If the lid 13 is locked at the closed position, the engaging plate 25 pushes the front surface of the engaged plate 26, so that the paper dust receiver 14 is held in the contained position against a biasing spring force. If the locking mechanism 32 is released, the engaged plate 26 pushes the engaging plate 25 by the spring force of the biasing member 31, and then the paper dust receiver 14 is moved in the removing direction while the lid 13 is rotated to the open position.

Figure 7:
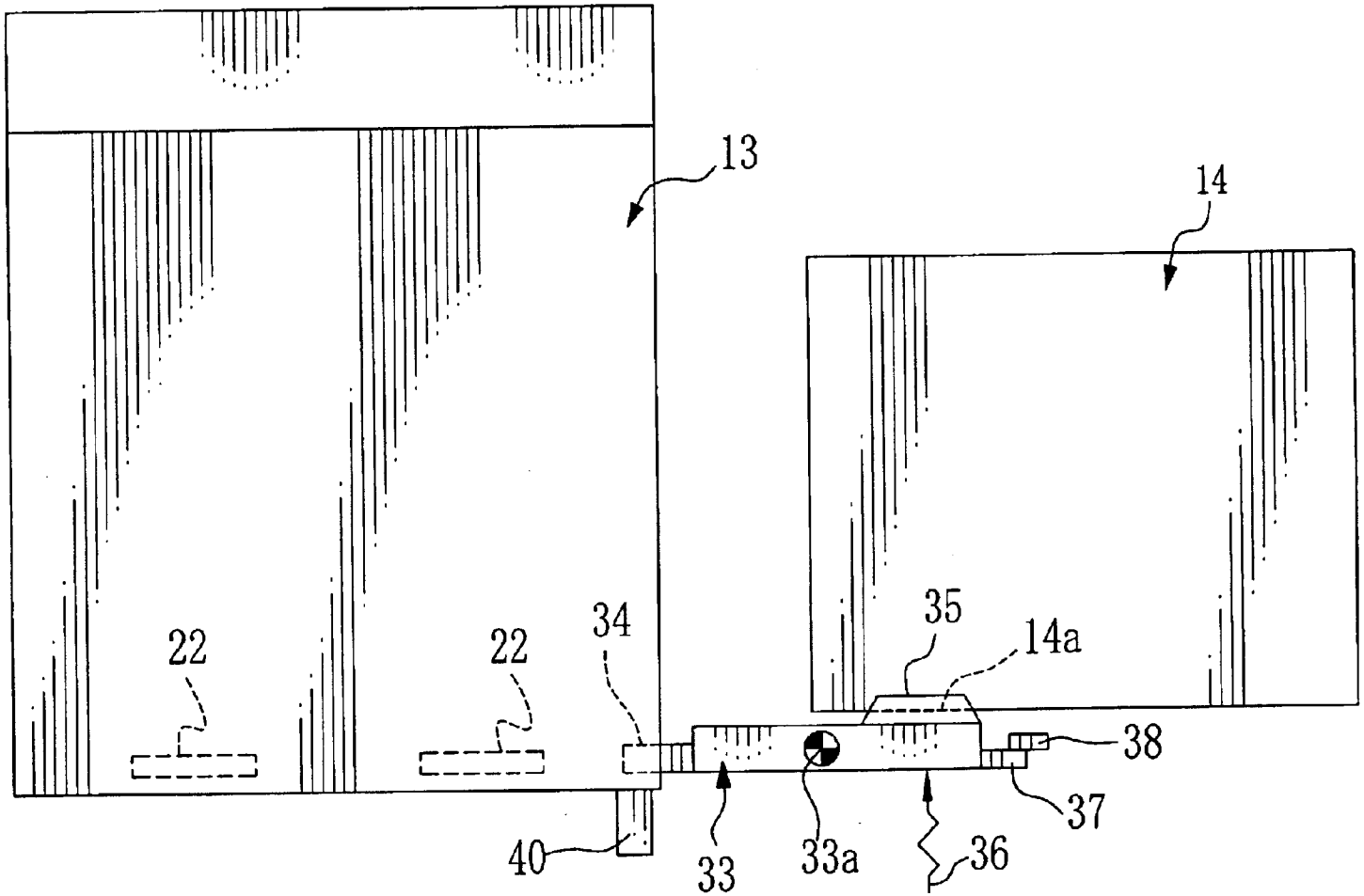
FIG. 7 is a front view showing another preferred printer provided with an interlocking lever, wherein there are a lid and a paper dust receiver respectively in a closed position and a contained position.
Figure 8:
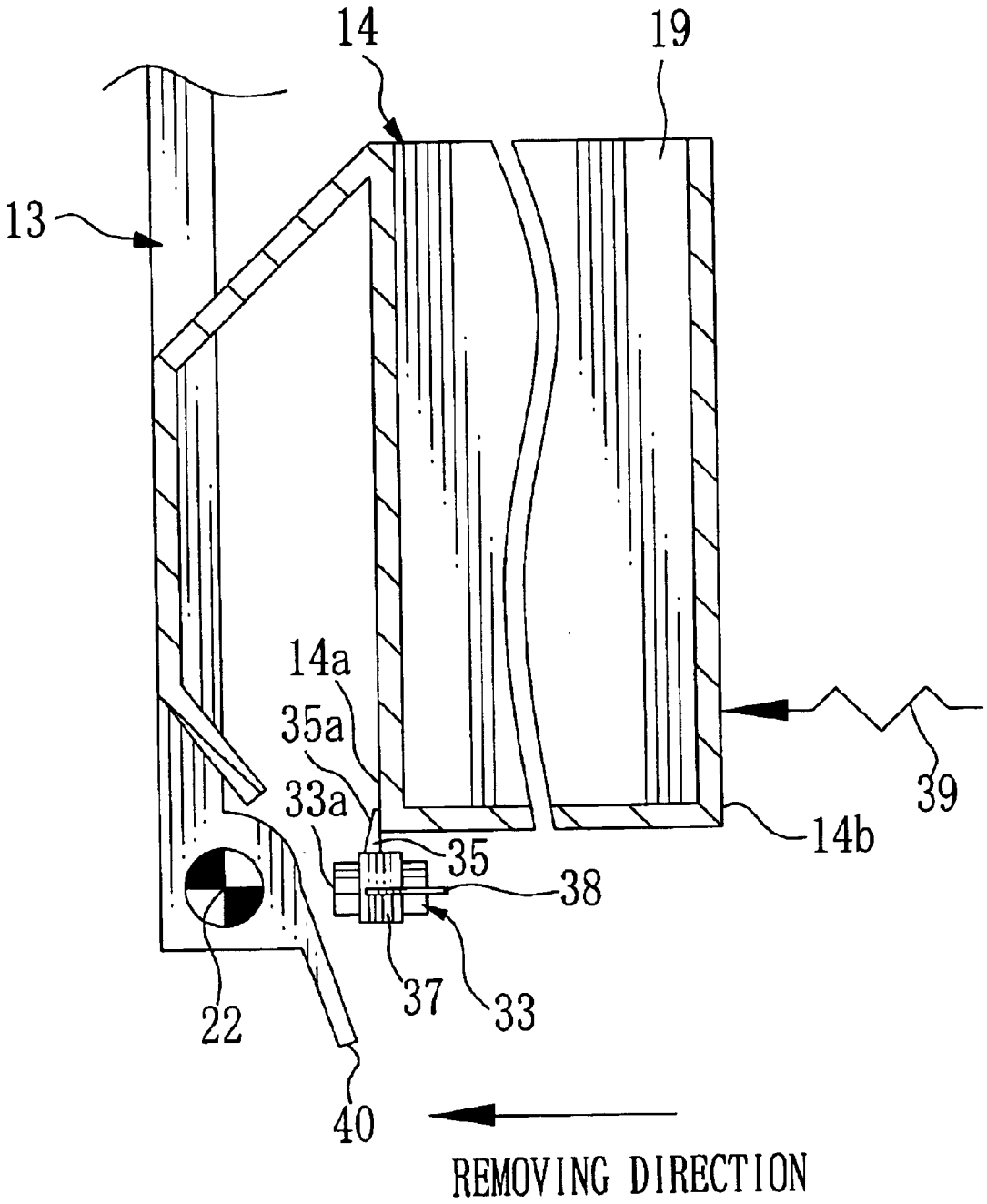
FIG. 8 is an approximately sectional view of the printer shown in FIG. 7.

As another preferred embodiment, an interlocking lever may be provided between the lid and the paper dust receiver. The interlocking lever moves the paper dust receiver 14 to the exposed position in association with the opening operation of the lid 13. As shown in FIG. 7 and FIG. 8, the interlocking lever 33 is rotated freely around a shaft 33*a* parallel to the removing direction of the paper dust receiver 14. One end of the interlocking lever 33 has an engaging portion 34 engaged with the lid 13, and another end has a stopper plate 35 holding the paper dust receiver 14 in the contained position.

The interlocking lever 33 is rotated between the locked position where the paper dust receiver 14 is locked by engaging with the stopper plate 35 and the released position where the lock is released, and then the paper dust receiver 14 is biased toward the locked position by a biasing member 36. When the interlocking lever 33 is in the locked position, a protrusion 37 attached to the end of the interlocking lever 33 is in contact with a stopper member 38. Note that a biasing member 39 shown in FIG. 8 biases the paper dust receiver 14 in the removing direction (to the exposed position). Additionally, an engaging portion 40 provided in the lid 13 is engaged with an engaged portion 34 while the lid 13 is open, and then the interlocking lever 33 is rotated in the released position against the spring force of the biasing member 36.

When the lid 13 is closed, the engagement of the engaging portion 40 and the engaged portion 34 is released, so that the interlocking lever 33 is rotationally biased toward the locked position by the biasing member 36. The stopper member 38 is in contact with the protrusion 37 against the rotationally biasing of the interlocking lever 33. Therefore, the interlocking lever 33 is stopped at the locked position. When the interlocking lever 33 is in the locked position, the stopper plate 35 enters a moving track of the paper dust receiver 14, so as to engage with a front end part 14*a*. Thereby, the paper dust receiver 14 is held in the contained position against the spring force of the biasing member 39.

Figure 9:
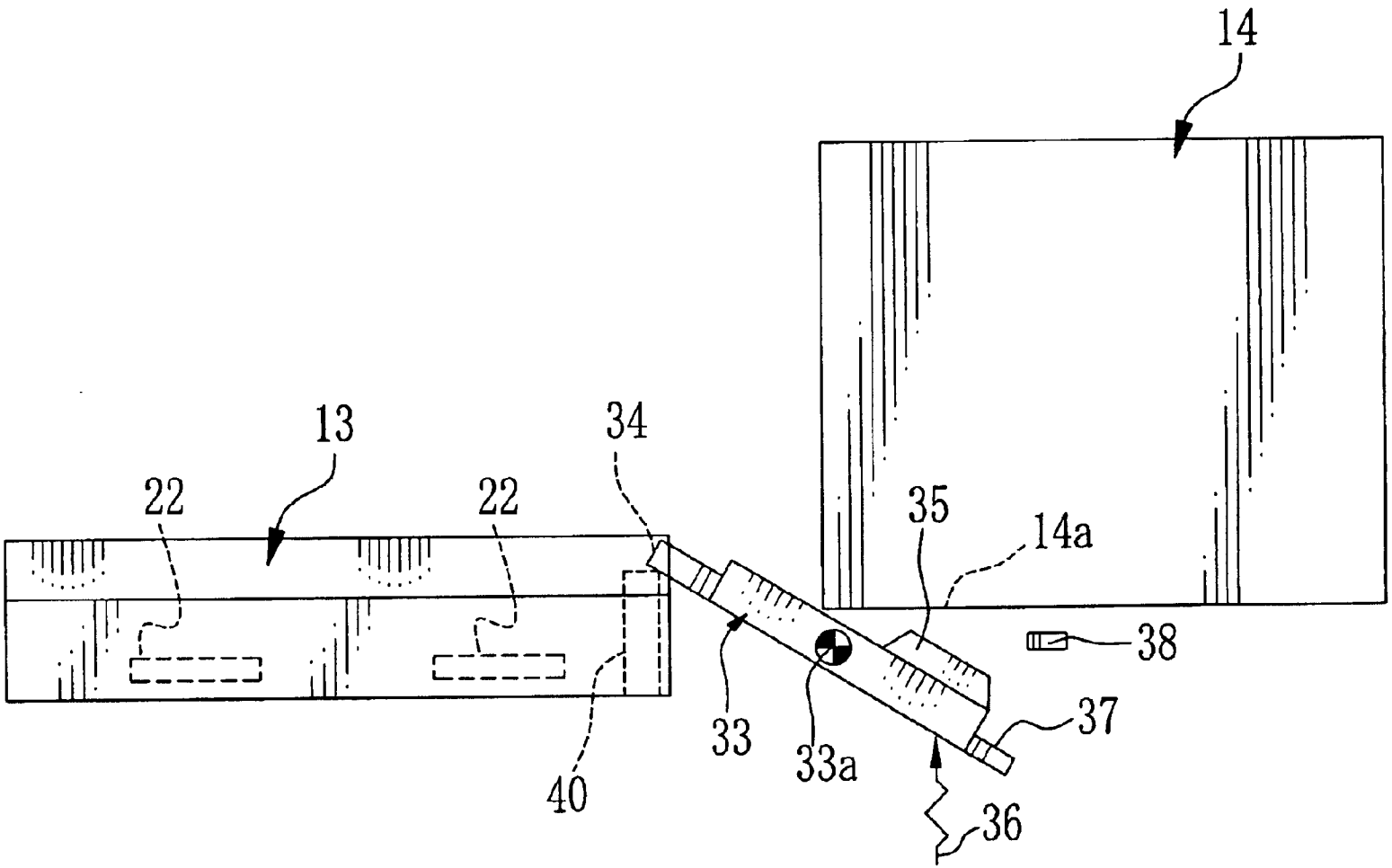
FIG. 9 is a front view of the printer, wherein the lid is open.
Figure 10:
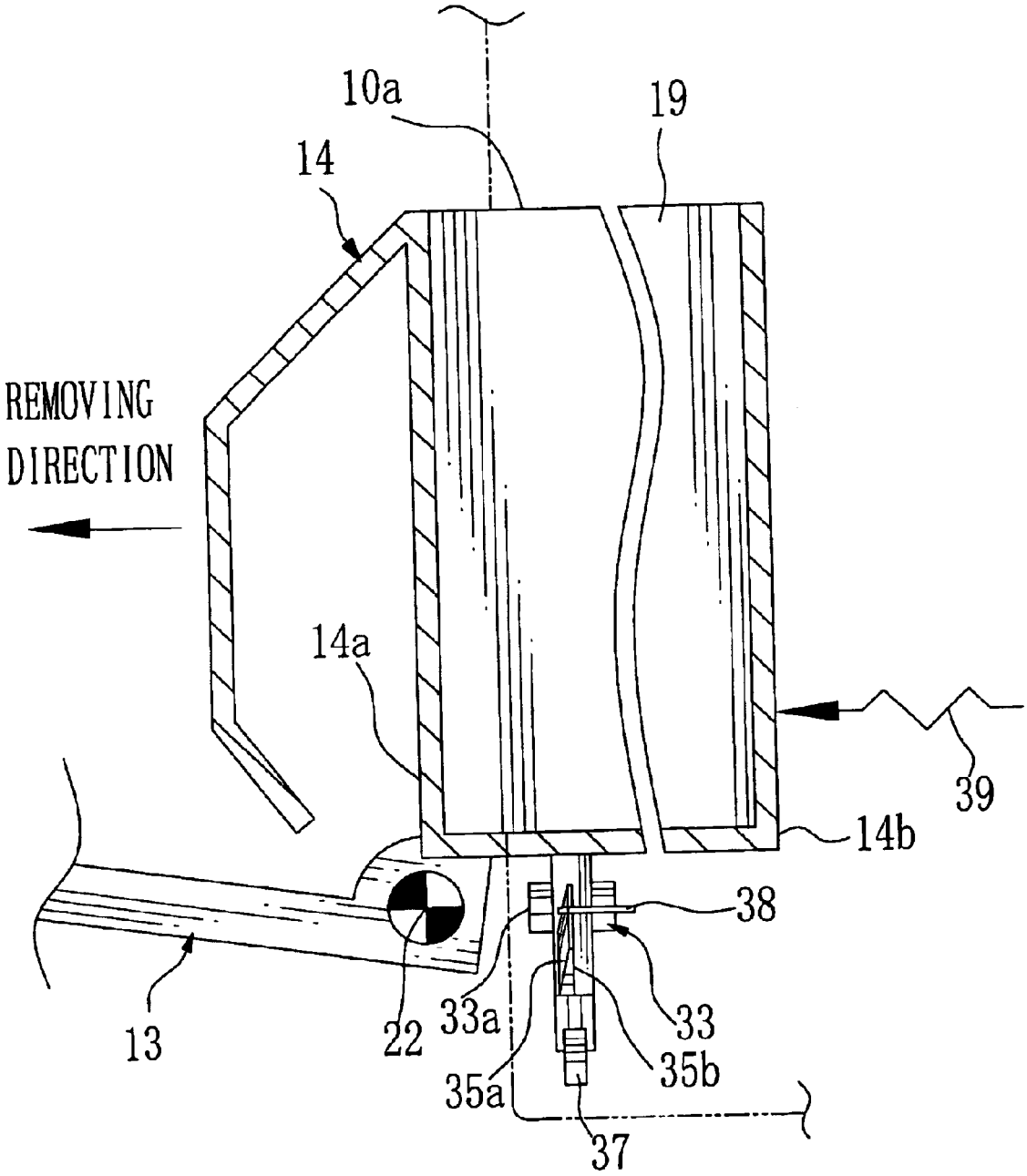
FIG. 10 is an approximately sectional view of the printer shown in FIG. 9.

While the lid 13 is moved to the open position, the engaging portion 40 depresses the engaged portion 34. Thereby, as shown in FIG. 9 and FIG. 10, if the interlocking lever 33 is rotated to the released position, the stopper plate 35 is retracted from the moving track of the paper dust receiver 14, and therefore the engagement of the stopper plate 35 and the paper dust receiver 14 is released. Thereby, the paper dust receiver 14 is pushed out to the exposed position from an opening 10*a* of the printer 10 by the spring force of the biasing member 39. Accordingly, it is possible to confirm the paper dust amount in the paper dust receiver 14 at every exchanging of the recording paper.

If the paper dust receiver 14 is not removed from the printer 10, the bottom surface of the paper dust receiver 14 is existed on the moving track of the stopper plate 35. If the lid 13 is closed when the paper dust receiver 14 is positioned in the exposed position, although the engagement of the engaging portion 40 and the engaged portion 34 is released, the interlocking lever 33 cannot be rotated to the locked position since the stopper plate 35 is in contact with the bottom surface of the paper dust receiver 14. The paper dust receiver 14 is pushed into the contained position, so that the bottom surface of the paper dust receiver 14 is away from the moving range of the stopper 35. Accordingly, the interlocking lever 33 is rotated in the locked position to lock the paper dust receiver 14.

After the paper dust receiver 14 has been removed from the opening 10*a* of the printer 10, if the lid 13 is closed in a state that nothing is existed on the moving track, the interlocking lever 33 is rotated to the locked position. If the paper dust receiver 14 is inserted into the opening 10*a*, the paper dust receiver 14 cannot be pushed therein since the stopper plate 35 is opposed thereto on the moving track. As shown in FIG. 10, a slope 35*a* inclined to the removing direction is provided in a front surface of the stopper plate 35 into which a rear end 14*b* of the paper dust receiver 14 is pushed. The interlocking lever 33 can be rotated to the released position after the slope 35*a* has been depressed by the rear end 14*b* of the paper dust receiver 14. On the other hand, a rear surface 35*b* of the stopper plate extends substantially perpendicular to the removing direction. Accordingly, if the paper dust receiver 14 is inserted into the opening 10*a* after the lid 13 has been closed, the paper dust receiver 14 can be contained in the contained position.

Note that a printer in the present invention may be a thermal printer, an ink jet printer, a silver-salt photograph printer, and a feeding magazine thereof, instead of the color thermal printer. Additionally, a printer for normal plain paper in which waterproofing and dampproofing are not required can also be applied to the present invention. In this case, a sheet of paper may be used. Moreover, the printer may include a receiver for accumulating the paper dust generated by cutting off the margins may be provided in the printer, and interlocking means for pushing out the receiver outside in association with the operation of removing a paper-feeding cassette.

It is to be understood that the above-described embodiments are simply of the invention. Other embodiments may be devised by those skilled in the art which will embody the principal of the invention and fall within the sprit and scope thereof.

What is claimed is:

1. A printer with a cutter device for cutting a part of a recording material after an image has been recorded on said recording material fed from a loading chamber, said printer comprising:

a receiver including a containing chamber for containing paper dust generated by cutting said recording material;

a lid which is movable between a closed position to cover said loading chamber and an open position to expose said loading chamber; and an interlocking mechanism for connecting said lid with said receiver, said receiver being moved from a contained position where said containing chamber is completely contained in said printer to an exposed position where a part of said containing chamber is exposed in association with the movement of said lid to said open position.

2. A printer as claimed in claim 1, wherein said interlocking mechanism comprises:

an engaging member fixed to said lid; and an engaged member fixed to said receiver, wherein said engaging member pushes said engaged member to move said receiver to said exposed position in association with movement of said lid to said open position.

3. A printer as claimed in claim 2, further comprising:

a guide rail formed in said printer; and a rail receiving portion formed in said receiver, said rail receiving portion being engaged with said guide rail and guiding movement of said receiver.

4. A printer as claimed in claim 2, wherein said receiver is provided with a flap operated externally to move said receiver.

5. A printer as claimed in claim 2, wherein said lid is rotatable between said closed position and said open position, and said engaging member is in moving range of said engaged member when said lid is in said open position.

6. A printer as claimed in claim 1 further comprising a biasing member for biasing said receiver toward said exposed position, wherein said interlocking mechanism comprises:

a lever which is movable between a holding position to hold said receiver in said contained position against spring force of said biasing member and a released position where said receiver is released; and an engaging member fixed to said lid, for moving said lever to said released position while said lid is moved to said open position.

7. A printer as claimed in claim 6, wherein said lever is biased to said holding position, and said printer further comprises:

a stopper which is in contact with said lever located in aid holding position.

8. A printer as claimed in claim 6, wherein said lever comprises a holding plate to hold said lid, said holding plate having a front surface inclined to the direction of movement of said receiver, and a rear surface substantially perpendicular to the direction of movement of said receiver, and wherein said receiver in said contained position comes in contact with said rear surface of said holding plate.

9. A printer as claimed in claim 1, further comprising a biasing member for biasing said receiver to said exposed position, wherein said interlocking mechanism comprises:

an engaging member fixed to said lid; and an engaged member fixed to said receiver, wherein said receiver is released to move said exposed position by the spring force of said biasing member while said lid is moved to said open position.

* * * * *